US007026560B2

(12) United States Patent
Terhune et al.

(10) Patent No.: US 7,026,560 B2
(45) Date of Patent: Apr. 11, 2006

(54) SEPARABLE, FLEXIBLE ELECTRICAL CONNECTION ARRANGEMENT

(75) Inventors: Daniel M. Terhune, Chicago, IL (US); David Potter, Chicago, IL (US); Roy T. Swanson, LaGrange Park, IL (US)

(73) Assignee: S&C Electric Co., Chicago, IL (US)

( * ) Notice: Subject to any disclaimer, the term of this patent is extended or adjusted under 35 U.S.C. 154(b) by 301 days.

(21) Appl. No.: 10/681,729

(22) Filed: Oct. 8, 2003

(65) Prior Publication Data

US 2004/0110403 A1 Jun. 10, 2004

Related U.S. Application Data

(60) Provisional application No. 60/418,083, filed on Oct. 11, 2002.

(51) Int. Cl.
*H01H 24/00* (2006.01)

(52) U.S. Cl. ..... 200/51 R; 439/9; 439/188

(58) Field of Classification Search ..... 200/51 R; 439/6–9, 188

See application file for complete search history.

(56) References Cited

U.S. PATENT DOCUMENTS 5,709,553 A * 1/1998 Opfer et al. ..... 439/6
5,904,577 A * 5/1999 Swanson et al. ..... 439/8
6,554,636 B1 * 4/2003 Walker et al. ..... 439/484

* cited by examiner

*Primary Examiner*—K. Lee
(74) *Attorney, Agent, or Firm*—James V. Lapacek

(57) ABSTRACT

A separable, flexible connection arrangement is provided for connection of two conductors. In one arrangement, the separable, flexible connection arrangement is utilized to provide an externally removable bushing for connecting an electrical component located within a sealed enclosure.

3 Claims, 2 Drawing Sheets

SEPARABLE, FLEXIBLE ELECTRICAL CONNECTION ARRANGEMENT

This application claims the benefit of U.S. Provisional Application No. 60/418,083 filed on Oct. 11, 2002.

BACKGROUND OF THE INVENTION

1. Field of the Invention

The present invention relates generally to flexible connections and more particularly to an externally removable bushing that provides a flexible connection to components located within a switchgear.

2. Description of the Related Art

Switchgear for electrical power distribution systems commonly include enclosures defining contained environment desirable for circuit-interrupting functions of the enclosed components. In order to connect the enclosed components to external power cables, a bushing is utilized to provide a conductor through the sealed enclosure of the switchgear and to insulate the conductor from the enclosure. The bushing typically includes provisions for assembly with separable connectors which interface between the bushing and the power cables. The external portions of the bushing are subject to damage which may render the bushing unusable, requiring replacement of the bushing. This requires disconnection of the bushing from the enclosed components. If this disconnection of the bushing requires opening of the enclosure, the replacement of the bushing is not only time-consuming and difficult to perform in confined spaces, the design of the switchgear enclosure is also complicated thereby since opening features must be incorporated.

U.S. Pat. Nos. 4,767,351 and 5,904,577 illustrate arrangements that provide an externally-separable bushing such that connection and disconnection to enclosed components may be accomplished external to the enclosure and not requiring opening of the enclosure. In U.S. Pat. No. 4,767,351, the conductor of that bushing arrangement includes a cylindrical rod which is permanently and rigidly attached to the enclosed component and a sleeve with annular passage that receives the rod. The bushing also includes provisions for threadably connecting the two conductor parts. Thus, the bushing is removed by unthreading of the bushing from the cylindrical conductor such that the remainder of the bushing may be removed. This arrangement also requires provisions for sealing the junction of the two conductor parts.

While the prior art arrangements may be useful to provide connections to enclosed electrical components, it is always desirable to provide simplified manufacture and structure.

SUMMARY OF THE INVENTION

Accordingly, it is a principal object of the present invention to provide an externally removable bushing connector that provides connection to an electrical component located within a switchgear enclosure while providing ease of use and a flexible connection to the electrical component.

These and other objects of the present invention are efficiently achieved by the provision of a separable, flexible connection arrangement for two conductors. In one arrangement, the separable, flexible connection arrangement is utilized to provide an externally removable bushing for connecting an electrical component located within a sealed enclosure.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
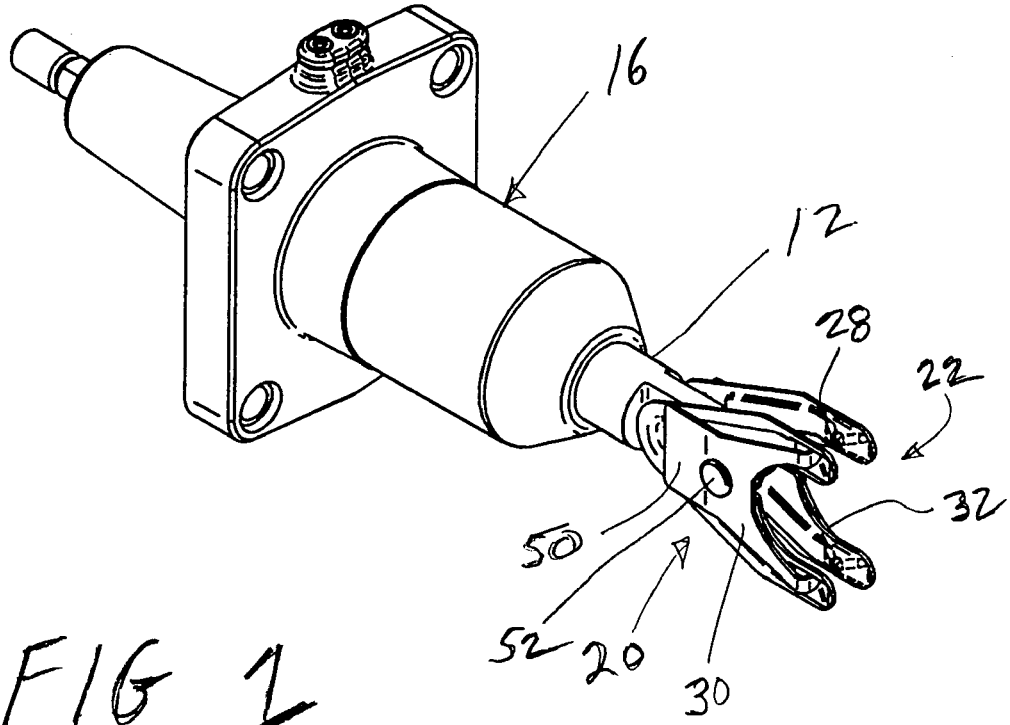
FIG. 1 is a perspective view of the connection arrangement of the present invention.
Figure 2:
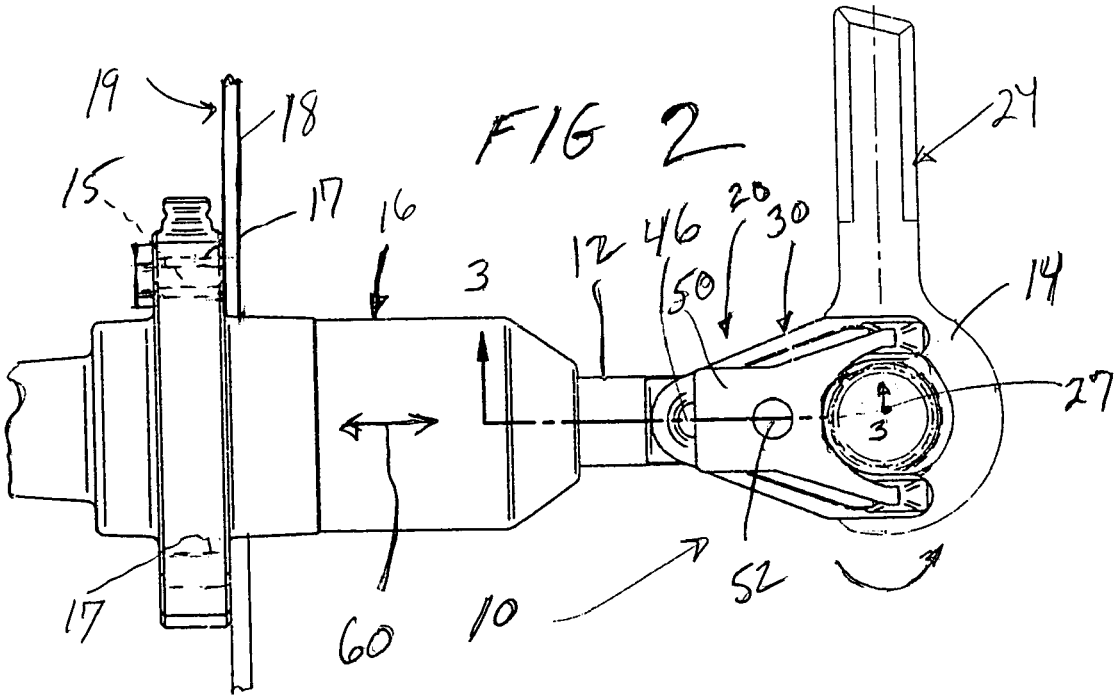
FIG. 2 is a top plan view of FIG. 1 and including a switch blade assembly.

Referring now to FIGS. 1–6, the connection arrangement 10 of the present invention provides a separable, flexible electrical connection between two conductors 12, 14. In a specific illustration as shown in FIGS. 1 and 2, the conductor 12 of the connection arrangement 10 is the conductor of a bushing 16 that is externally removable with respect to a wall 18 of an enclosure 19 (FIG. 2). The conductor 14 provides electrical connection to an electrical component (not shown) housed in the enclosure 19. The bushing 16 is removable from the wall 18 via a fastening arrangement, e.g. fasteners 15 that are carried by the wall 18 and pass through apertures 17 in the bushing 16. Thus, when the bushing 16 is unfastened from the wall 18, the bushing 16 may be disconnected from the conductor 14 and removed for replacement etc. The connection arrangement 10 is movable along the direction 60 for connection to and disconnection from the conductor 14.

Figure 3:
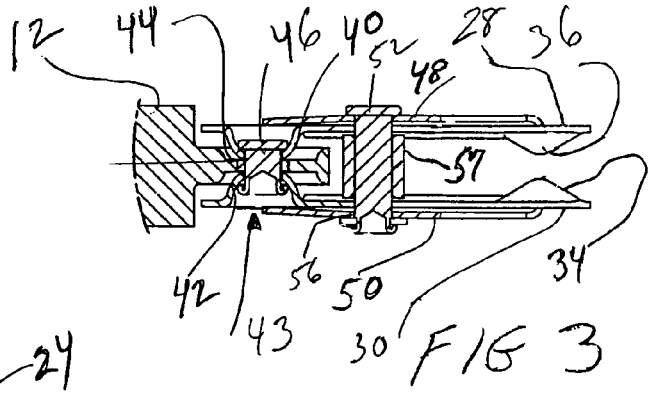
FIG. 3 is a partial, sectional view taken generally from the line 3—3 of FIG. 2.
Figure 4:
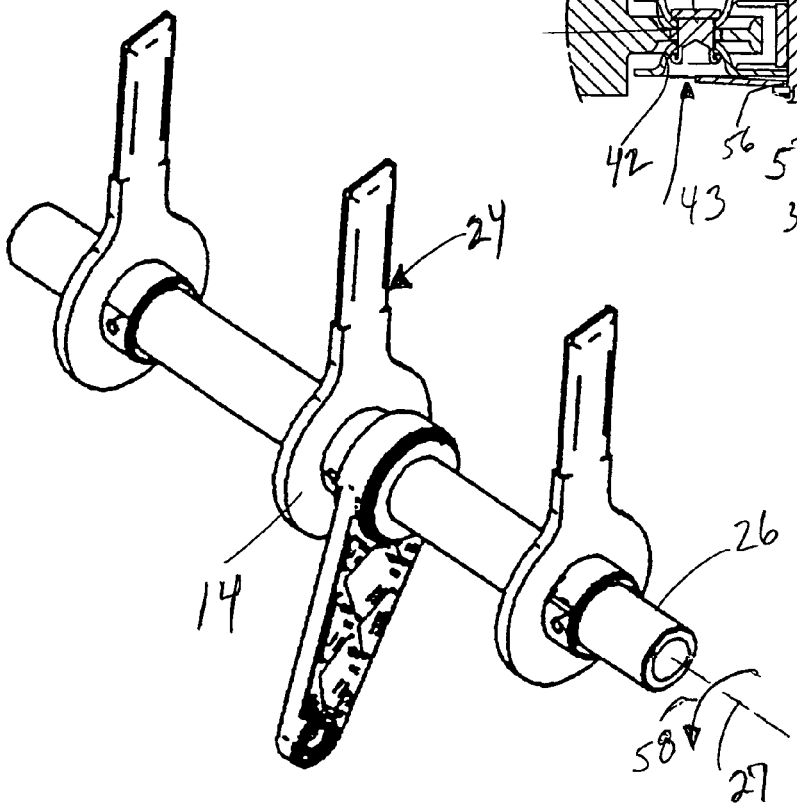
FIG. 4 is a perspective view of a switch blade assembly to which connection is made by the present invention.
Figure 5:
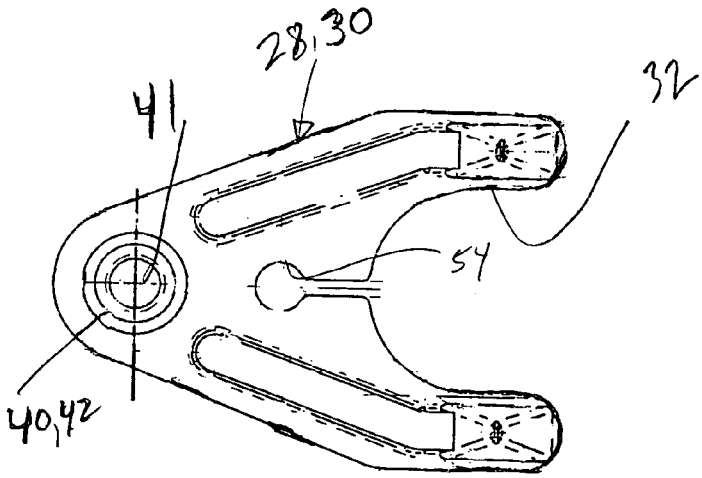
FIGS. 5 and 6 are respective front and right-side elevational views of a contact plate of the connection arrangement of the present invention.
Figure 6:
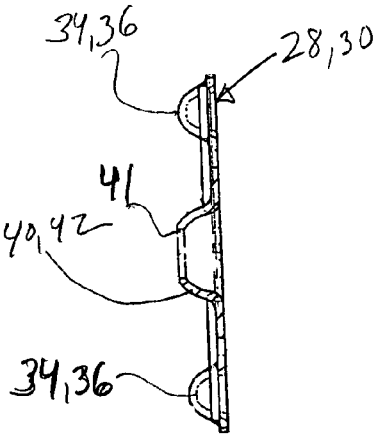

The connection arrangement 10 includes a contact arrangement 20 that makes electrical connection with the conductor 12 and includes a separable contact 22 that is arranged for separable connection with the conductor 14. In the illustrative example, the conductor 14 is a central hub portion of an overall switch blade assembly 24 that is carried on and rotates with an operating strut or shaft 26 about an axis 27 (FIG. 4). The separable contact 22 includes two parallel, opposed contact plates 28, 30 each of which including a y-shaped or yoke contact opening 32 along the leading edge thereof. The contact openings 32 interfit about the operating strut 26 while the plates 28, 30 engage the hub of the conductor 14 to provide the electrical connection thereof. As shown in FIG. 3, contact is made between the conductor 14 and the plates 28, 30 at protruding contact portions 34, 36 respectively provided at the upper and lower portions of the yoke contacts. In a preferred embodiment, the contact portions 34, 36 are elongated and tapered along an axial direction 60 of the bushing 16 while being generally curved in the direction transverse thereto as show in FIG. 6. The contact arrangement 20 includes generally spherical contact portions 40, 42 on the plates 28, 30 respectively to provide electrical connection with the conductor 12 at 43 via a slotted portion 44 of the conductor 12 and a rivet 46 that passes through apertures 41 in the spherical contact portions 40, 42. The contact arrangement 20 also includes two spring members 48, 50 disposed on the outside of the plates 28, 30 respectively and a rivet 52 that passes through apertures 54 in the plates 28, 30 and apertures 56 in the spring members

48, 50. The spring members are arranged to compress the spring members 48, 50 so as to provide a desired contact force, e.g. approximately 50 pounds. A spacer element 57 is provided about the rivet 52 and between the contact plates 28, 30. Thus, the contact arrangement 20 is movable for rotation about the rivet 46.

In accordance with important aspects of the present invention, the connection arrangement 10 provides a stable connection arrangement with resilient and flexible characteristics to accommodate positional changes between the conductors 12 and 14 while maintaining desired electrical connection and contact pressure, and also permits the bushing 16 to be removed from the housing 19 without entering the interior of the enclosure 19 which is gas-filled in an illustrative embodiment. For example, the connection arrangement 10 prevents rotation of the contact plates 28, 30 away from the switch blade assembly 24 in the direction 58 via the engagement of the yoke portions around the operating strut 26. Furthermore, the connection arrangement 10 is prevented from sliding away from the switch blade assembly 24 in the direction 60 via the mounting of the bushing 16 and the limited movement of the contact arrangement 20 in the direction 60. Thus, the connection arrangement 10 provides separable, but definite orientation and stability.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

The invention claimed is:

1. An electrical connection arrangement for providing interconnection between a first conductor and a second conductor, the arrangement comprising:

an externally removable, separable bushing connector for providing an electrical connection through a wall comprising an insulating portion, a first conductor extending through said insulating portion, means for fastening said insulating portion to the wall, and connection means carried by said first conductor;

a switch blade member including a cylindrical member defining said second conductor; and a shaft carrying said switch blade member, said connection means comprising first contact portions for providing electrical connection to said second conductor and interfitting about said shaft, whereby connection is effected via relative movement between said first and second conductors.

2. The electrical connection arrangement of claim 1 wherein said connection means comprises flexible connection means for relative movement between said first and second conductors when connected.

3. The electrical connection arrangement of claim 1 wherein said first contact portions comprise two spaced plates each having a yoke-shaped opening, the two spaced plates engaging said cylindrical member on opposite sides thereof.

* * * * *